US005647494A

United States Patent [19]

de Schaetzen et al.

[11] Patent Number: 5,647,494

[45] Date of Patent: Jul. 15, 1997

[54] TEAR-OFF CLOSURE FOR BOTTLE-SHAPED CONTAINERS

[75] Inventors: Serge L.G.M.G. de Schaetzen, Hoeselt; Koen L.E. Van Den Langenbergh, Wilrijk, both of Belgium

[73] Assignee: Helvoet Pharma Belgium N.V., Alken, Belgium

[21] Appl. No.: 521,108

[22] Filed: Aug. 29, 1995

[30] Foreign Application Priority Data

Aug. 30, 1994 [DE] Germany ..... 44 30 741.1

[51] Int. Cl.[6] ..... B65D 41/62

[52] U.S. Cl. ..... 215/249; 215/251; 215/254

[58] Field of Search ..... 215/247, 249, 215/251, 254

[56] References Cited

FOREIGN PATENT DOCUMENTS

| | | |
|---|---|---|
| 2727743 | 8/1977 | Germany . |
| 3241283 | 5/1983 | Germany . |
| 8709042 | 6/1987 | Germany . |
| 8906346 | 5/1989 | Germany . |
| 4135470 | 10/1991 | Germany . |
| 4228090 | 8/1992 | Germany . |
| 4241009 | 12/1992 | Germany . |
| 4307803 | 3/1993 | Germany . |

*Primary Examiner*—Stephen K. Cronin

*Attorney, Agent, or Firm*—McAulay Fisher Nissen Goldberg & Kiel, LLP

[57] ABSTRACT

A tear-off safety closure is described in particular for ensuring authenticity and for additional sealing of a bottle-shaped container containing especially pharmaceuticals which is already closed by a disk-shaped or plug-shaped sealing element. The cap surface and the closed flange-shaped jacket of the closure enclose the sealing element and the rim of the container neck which has an outwardly projecting ridge. The closure has a tear-out part which can be detached to expose the surface of the sealing element, e.g., for piercing with a hypodermic needle. The jacket has retaining devices which are arranged on its inner surface at a distance from its lower edge and which engage under the lower edge of the ridge. The closure is produced from plastic in its entirety and so as to form one piece, in particular from thermoplastically deformable plastic such as polypropylene or polyamide.

8 Claims, 7 Drawing Sheets

TEAR-OFF CLOSURE FOR BOTTLE-SHAPED CONTAINERS

BACKGROUND OF THE INVENTION a) Field of the Invention

The invention is directed to a tear-off safety closure in particular for ensuring authenticity (indicating evidence of tampering) and for additional sealing of a bottle-shaped container containing especially pharmaceuticals which is already closed by a disk-shaped or plug-shaped sealing element. The cap surface and the closed flange-shaped jacket of the closure enclose the sealing element and the rim of the container neck which has an outwardly projecting ridge, this closure having a tear-out part which can be detached from its cap surface, and the jacket has retaining devices which are arranged on its inner surface at a distance from its lower edge and which engage under the lower edge of the ridge.

b) Description of the Related Art

A tear-off closure of the above type is described in DE-OS 27 27 743. It is formed entirely from metal, in particular aluminum. This closure is constructed as a beaded closure, i.e., it covers the sealing element closing the container and covers the neck of the container and engages under the latter in an annular zone located below the rim of the container neck having a ridge. This subsequent deformation, that is, the formation of a bead on the closure, is effected by means of a mechanical device which is arranged downstream in a bottling installation, so that the retaining means which secure the closure on the container are first produced by this mechanical device.

The advantages of such an aluminum closure, i.e., that it can be constructed by cold plastic deformation with suitable tools, that the material itself also has favorable strength and, finally, that common tolerances of the container and the sealing element can be compensated for easily, do not outweigh the disadvantages. One such disadvantage consists in that comparatively heavy mechanical devices for deforming the metallic closures which generate dirt, dust, etc. during operation and are also prone to operating disturbances must be installed in the clean and often sterile filling station for the containers. The sterile environment is also prejudiced by efforts to alleviate the operating disturbances.

A further disadvantage consists in that minute particles are detached from the aluminum alloys used for producing such beaded closures when they come into contact with other objects, especially with the sealing apparatus. This "dust" can very easily contaminate the sealing element and ultimately also the contents of the bottles. Contamination of parenteral preparations with aluminum dust, for example, must be prevented at all costs as this would pose a lethal risk for certain human organs.

But these known aluminum closures have yet a further disadvantage in that they cannot guarantee the authenticity and integrity of the contents of the container. Such metallic closures which are sealed by beading can be opened at the bead and later, again closed, with suitable tools so that the contents could be diluted, for instance, resulting in harmful consequences.

For this reason, one aim of the invention described herein is to provide a tear-off closure which can be produced not from metal, but entirely from thermoplastic in an injection molding process in which it receives its definitive shape, i.e., without having to undergo a final deformation by means of an additional apparatus only after the container to be closed has been filled in order to seal the container completely and safeguard its contents, and this closure is sensitive to tampering so that such tampering can be detected on the closure at any time.

Of course, closures produced from plastic are also already known, e.g., from DE-PS 41 35 470. This reference describes a plastic closing cap, in particular for glass containers used for a wide range of applications, which has a cap surface which can be partially pulled off so as to expose a seal or opening and has a jacket part surrounding the neck of the container. Grippers or spring tongues which are swivelable via predetermined weak points in the material are attached to the jacket part and have grip edges which are directed inward, i.e., toward the outer circumference of the container, and engage under the neck of the container on all sides when swiveled vertically in the closing position. In so doing, the grippers meet and overlap one another in their entirety or individually in a tightly connected manner in the closing position and are accordingly connected in a frictional or positive engagement to form a closed surface surrounding the container neck or are connected in variously divided segments to form such a surface.

This construction of swivelable grippers forming a grip edge and substituting for the beaded edge formed in an aluminum closure by the sealing apparatus is a very complicated form of fastening for such plastic closures. The molding dies used in a plastics injection molding device for producing such closures are themselves very complicated to manufacture. Further, if the closing edge of a container sealed by such a closure is accidentally struck, there is a very high risk that one or more grippers will detach so that a tight closure of the container is no longer ensured.

In order to prevent the detachment of one or more grippers, it is proposed in DE-PS 42 28 090 that an auxiliary cap be screwed over the closure so as to secure the grippers or spring tongues in the radial direction to prevent unwanted opening. Such an additional auxiliary cap also requires that an external thread be arranged on the outer circumference of the closure or on its grippers or spring tongues which renders the overall construction of such a closing device very complicated and difficult to use.

In this known plastic closure and in the closure described in DE-OS 43 07 803, the tear-off cover part of the cap surface is inserted in an opening of the cap surface of the closure having a suitable diameter and engages under the edges of the opening with a clamping lip which projects down in the form of a ring. The circumference of this clamping lip is provided with curved, projecting bulges terminating in the lip of the tear-off cover part. When the tear-off cover part is pulled out of the cap surface by means of the tab provided at this cover part, the frictional forces acting on the lip which is clamped between the sealing element and the underside of the cap surface can cause a loosening of material which is, of course, undesirable since it can lead to contamination.

Moreover, it is obvious that dirt, e.g., dust, etc., can deposit in the circular joint formed between the edges of the tear-off cover part and the edges of the opening in the cap surface of the closure during storage periods and transport periods. When the tear-off cover part is removed to access the contents of the container, this dirt may be distributed on the sealing element located below it and can contaminate the contents of the bottle when this sealing element is pierced by a hypodermic needle.

In other known constructions of plastic closures, these closures are placed over the neck of a bottle-shaped container provided with a sealing element, their cap surface having a circular center part which can be popped out of the cap surface when the closure is pressed down farther toward the container neck, e.g., by exerting a firm thumb pressure. For this purpose, the center part is connected with the outer edge of the cap surface of the closure, e.g., by four thin webs which span a narrow open gap formed between the center part and the edge of the cap surface. This also results in imperfect tightness of the plastic closure in the region of the cap surface, i.e., the sealing element itself is not covered in a sterile manner, but is only protected against unintentional mechanical damage and unwanted puncture prior to actual use of the contents of the bottle.

Therefore, another aim of the invention is to produce the tear-off closure described above in such a way that it is not only formed entirely of plastic but is also formed in one piece and to further develop this tear-off closure in such a way that it can nevertheless be torn off in a manner similar to the closure produced from aluminum and provides protection of the sealing element from contamination.

SUMMARY OF THE INVENTION

The aims of the invention described above are met in a tear-off closure made from plastic in that the closure is produced from plastic in its entirety and so as to form one piece, in particular from thermoplastically deformable plastic such as polypropylene or polyamide, and in that the retaining devices are constructed as inner projections which face the outer wall of the container neck and engage under the lower edge of the ridge.

This construction of the closure meets the objectives of the invention, namely to provide a safeguard of authenticity which ensures that tampering with the closure, especially by deforming the jacket area, will be immediately evident, to simplify removal as far as possible, that is, especially without loosening of material, and, for the rest, also to produce the closure from an easily recyclable material. Moreover, in comparison to the known retaining devices described above, the present construction of the retaining devices of the closure provides a solution which is simple to manufacture and which ensures that the closure can be fastened to the neck of the container without additional apparatus acting upon the retaining devices.

In order to facilitate the placement of the closure on the neck of the container and the closing process, the retaining devices are constructed in the manner of a shelf having a triangular cross section and a contact surface which engages approximately horizontally under the lower edge of the ridge. As a result of this construction, the closure can be placed lightly upon the container neck at first and then, when pressed down further, on the outer side of the ridge. In so doing, the jacket widens, slides down and then catches under the lower edge of the ridge with its retaining devices.

In order to improve their holding action, the retaining devices are constructed as elastically deformable lips which are formed out at the inner side of the lower edge of the jacket and are directed at an acute angle into the interior of the closure. This lip-shaped construction of the retaining devices ensures that these retaining devices can compensate in a particularly suitable manner for tolerances caused by manufacturing technique in the dimensions of the sealing element and in the ridge of the container neck and can secure the closure.

In a further development of the closure according to the invention, the tear-out part is constructed as a diametrically extending strip of determined width and is connected with the remaining adjoining circular segment-shaped regions of the cap surface by regions of reduced strength formed of thinner plastic material.

This construction of the closure according to the invention ensures that the closure can in fact be produced from plastic in one piece in a single injection molding process, a closure produced in this way being usable immediately. Supplementary to the above described embodiment of the tear-out part, it is to be noted that the strips are also connected to the edges of the jacket of the closure with weakened areas of thinner plastic material. A closure having such construction has no openings or slots through which dirt could penetrate so as to contaminate the sealing plug.

In an advantageous further development of the invention, the jacket has a reduced outer diameter in the region of its outer circumference, so that in this region at the tear-out part a grip edge is formed. This grip edge of the tear-out part is formed by the end of the diametrically extending strip which ends directly over the upper edge of the jacket. Due to this construction, it is no longer necessary to provide a special tab which projects out freely over the cap surface or circumference of the closure for grasping and detaching the tear-out part. This also considerably simplifies the injection molding process for producing the closure.

According to the invention, the tear-out part can provide at its edge located opposite the grip edge, a hinge-like transition to the jacket at which the tear-out part can be folded up after detaching it from the cap surface and can remain in this position. The provision of such hinge prevents the torn out tear-out part, on the one hand, from being separated completely from the closure if it is not wished, and also, on the other hand, from folding back again when released and accordingly impeding the penetration of a hypodermic needle into the exposed sealing element.

The line-shaped weakened regions contained in the cap surface are advantageously extended in length into the jacket corresponding to the width of the strip. This extending of the weakened regions ensures not only that the tear-out part can be folded up at the hinge construction, but also that the closure can be completely ripped open, if the tear-out part is pulled further, so that it is possible to remove it entirely from the container. In order to prevent this from happening in a single action, at least when not intended, one of the line-shaped weakened regions does not lead completely to the lower edge of the jacket. Accordingly, the tear-out part cannot be entirely detached from the closure and a pull-force type connection remains so that the entire torn off closure is detached from the container only when executing an additional vigorous pulling of the tear-out part.

In the construction according to the invention, notch-shaped regions are provided in each instance in the lower edge of the jacket between the two line-shaped weakened regions and the thinner jacket region for the grip edge so as to supplement these regions, the jacket likewise having a thinner construction in these notch-shaped regions. These notch-shaped regions, amounting to four altogether, are arranged at a distance of approximately one eighth of the circumference of the jacket from one another and from the line-shaped weakened regions and thinner jacket region. These notch-shaped regions serve to facilitate the widening of the jacket in this region of its edge when placed on the container neck.

In another construction of the closure according to the invention, the edge of the jacket is extended downward along its entire circumference, wherein the edge can terminate in a downward direction in a continuously tapering manner in those portions of the extended region in which the thickness of the jacket is not reduced. This extended region is an additional protective measure for ensuring the authenticity of the contents of the container. The particularly sensitive construction of the extended region which was described above is more flexible than the rest of the jacket region and might even be described as soft and should rest on the shoulder of the container. Anyone attempting to open a container which has been sealed with such a closure would have to reach under this extended region. However, this could not be done without damaging the closure in this extended region which would make it apparent that the closure had been tampered with.

The cap surface advantageously has an annularly extending ridge at its underside which is intended to contact the upper side of the sealing element. Since this ridge which is formed at the underside of the cap surface and has a determined height is harder than the rubber sealing element, it can easily compensate for tolerances between the underside of the cap surface and the upper side of the sealing element which occur due to manufacturing tolerances in the dimensions of the sealing element, container neck, ridge, and in the closure itself, i.e., in that it penetrates deeper into a thicker sealing element than into a thinner sealing element and accordingly forces the sealing element to deflect laterally. Further, this ensures that the sealing element will always be pressed firmly into the container neck.

An embodiment example which describes the invention by way of example without limiting the invention is explained in the following with reference to the drawings.

DESCRIPTION OF THE PREFERRED EMBODIMENTS

Figure 1:
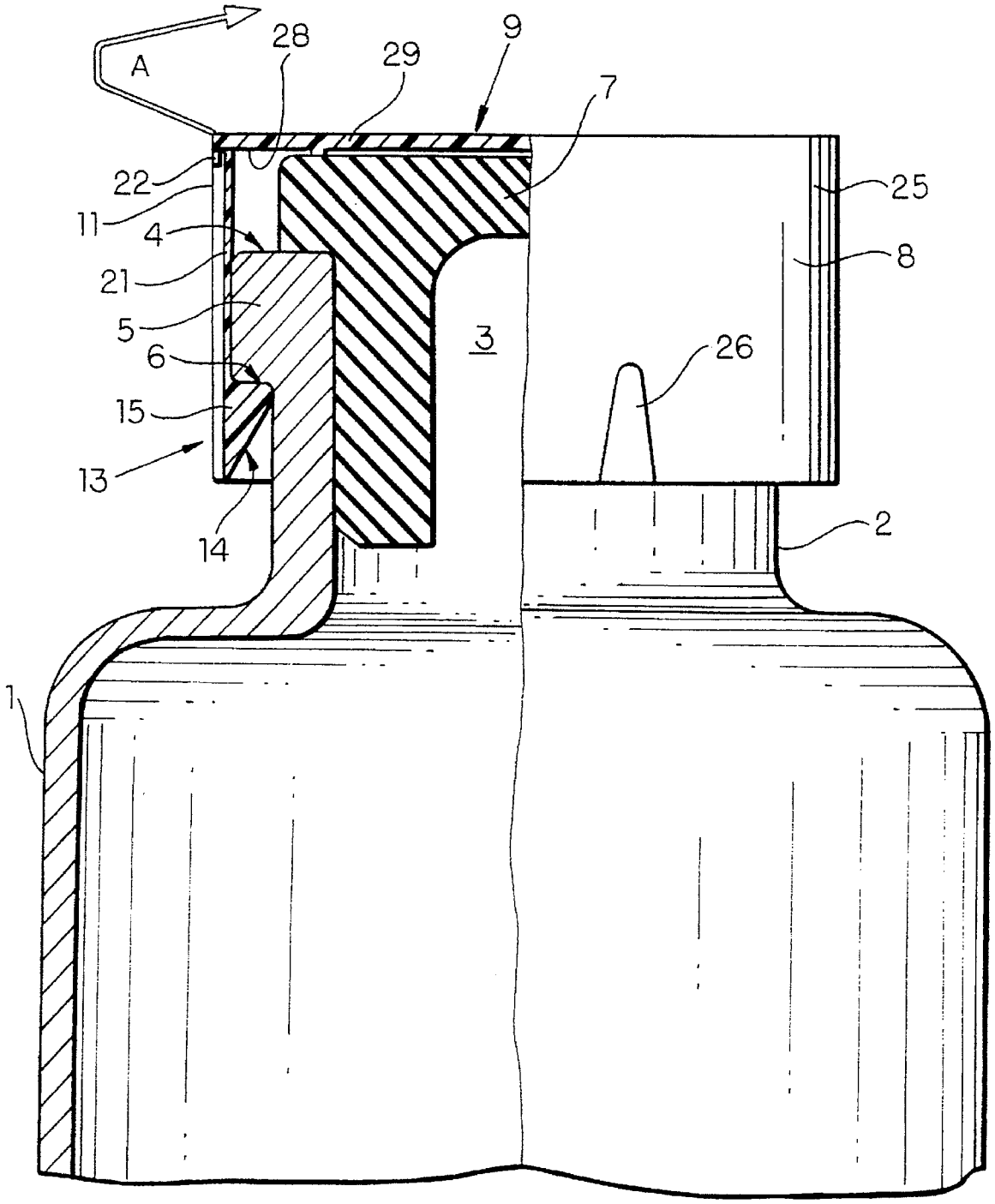
FIG. 1 shows a partial section through the container, the sealing element closing the container, and the closure arranged over the latter with a first embodiment form of the retaining device.

The bottle-shaped container 1 shown in the drawings which is intended in particular to contain pharmaceuticals has a container neck 2 of reduced diameter. The rim 4 of the container neck 2 forming the container opening 3 has an outer ridge 5 which has a greater outer diameter than the container neck 2 and projects out over the container neck 2 by a lower edge 6.

The container opening 3 of the bottle-shaped container 1 is closed by a plug-shaped sealing element 7 which seals the contents of the container 1 from the environment in a sterile manner and which, for example, can be pierced by a hypodermic needle, not shown in the drawings, to remove the contents of the container.

The sealing element 7 is covered in turn by a closure 8 for additional sealing and especially for safeguarding. The closure 8 which is produced entirely and in one piece from plastic also overlaps the rim 4 with the ridge 5 and has a device by means of which the closure 8 can be opened at least far enough to partially expose the sealing element 7.

In addition, the closure 8 has a cap surface 9 of a determined thickness in which is provided a tear-out part 10 which can be detached from the cap surface 9 so as to allow access to the sealing element 7, e.g., in order to pierce the latter by means of a hypodermic needle as described above. Further, the closure 8 has a flange-shaped jacket 11 which has a determined height adapted to the dimensions of the ridge 5 and those of the sealing element 7 and has retaining devices 14 at the inner side 12 of its lower edge 13 which are constructed as projections 15 which face inward, i.e., toward the outer wall of the container neck 2, and engage under the lower edge 6 of the ridge 5.

Figure 3:
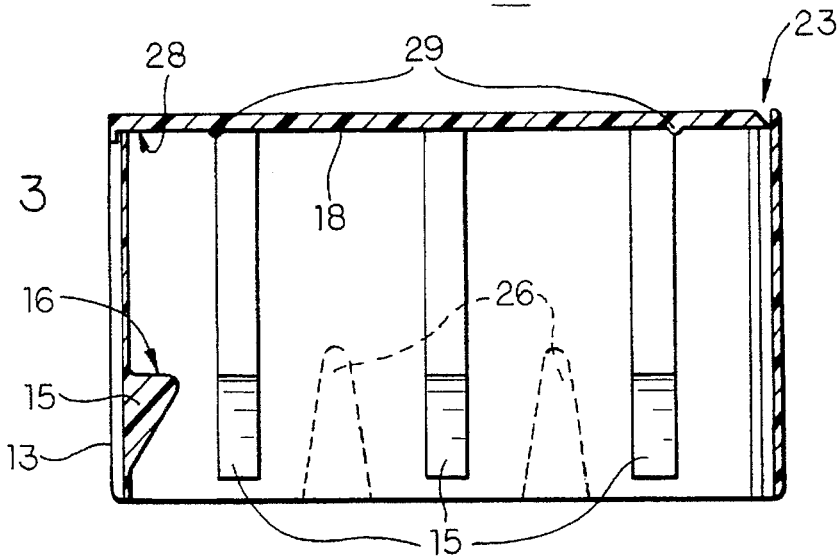
FIG. 3 shows a section along line III—III of FIG. 2.
Figure 4:
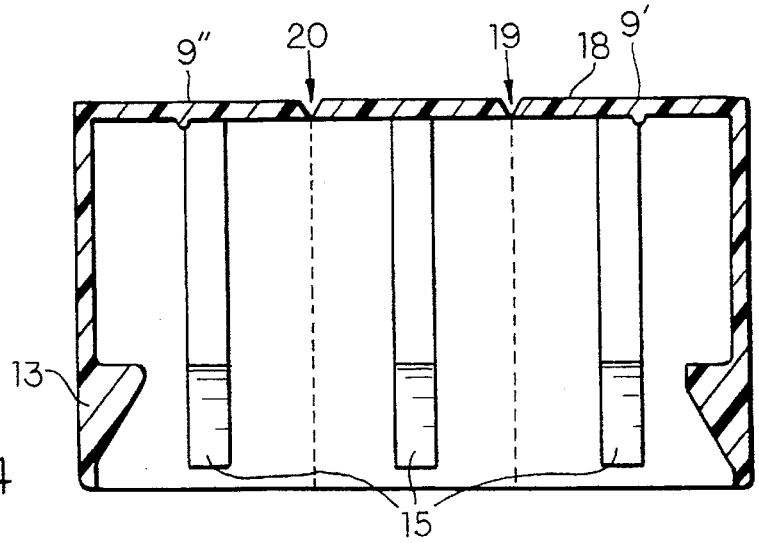
FIG. 4 shows a section along line IV—IV of FIG. 2.

As is shown particularly in FIGS. 1, 3 and 4, these projections 15 are so constructed with respect to their cross-sectional dimensions that they can easily slide over the rim 4 of the container neck 2, in particular over the ridge 5, when the closure 8 is placed on this rim 4 and then pressed down further, but can no longer be pulled off of the container neck 2, at least not without damaging the jacket, after locking in under the lower edge 6 of the ridge 5.

In addition, the projections 15 are, for example, constructed in the manner of a shelf having a triangular cross section and a contact surface 16 which engages approximately horizontally under the lower edge 6 of the ridge 5 so that the shelf first makes contact when the closure 8 is placed on the rim 4 or ridge 5 of the container neck 2 and then, when pressing down farther, causing the jacket 11 to expand, slides down and subsequently snaps in under the lower edge 6 of the ridge 5 with its contact face 16.

In order to maintain and possibly improve the retaining effect of the retaining devices 14, especially when a thinner sealing element is combined with a ridge having smaller dimensions or, conversely, when a thicker sealing element is combined with a thicker ridge having larger dimensions, the retaining devices 14 are constructed as elastically deformable lips 17 which are formed on at the inner side 12 of the lower edge 13 of the jacket 11 and are directed into the interior of the closure 8 at an acute angle.

Figure 5C:
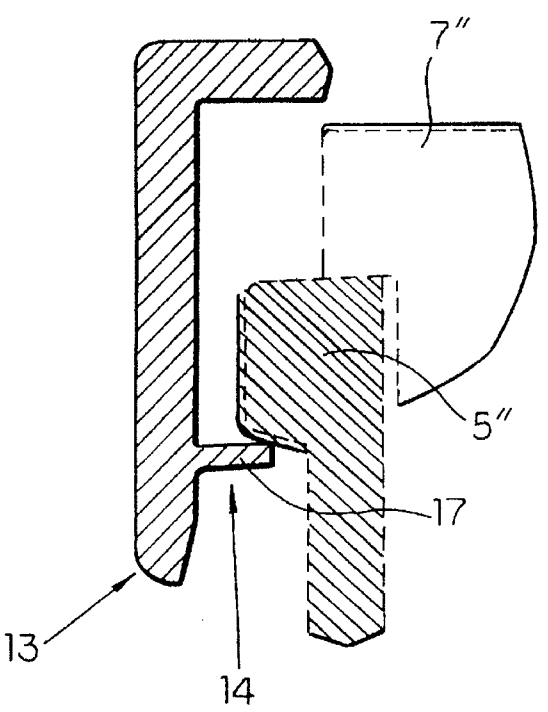
FIG. 5*c* shows a section through the closure placed on the container and through the ridge, in which the sealing element and ridge have maximum dimensions.
Figure 5B:
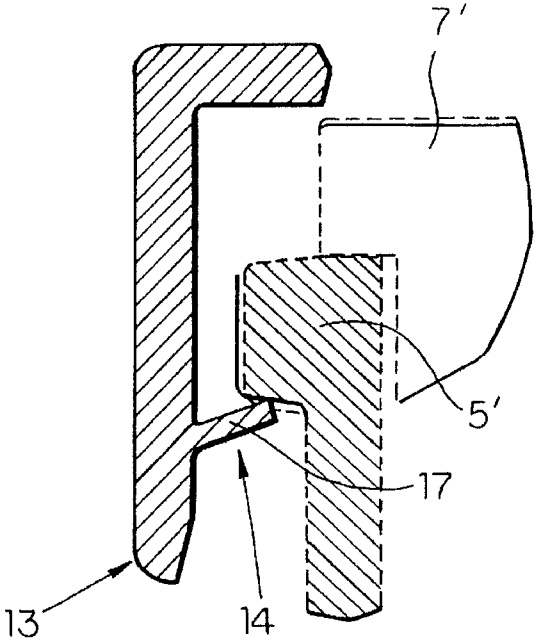
FIG. 5*b* shows a section through the closure placed on the container and through the ridge, in which the sealing element and ridge have minimum dimensions.
Figure 5A:
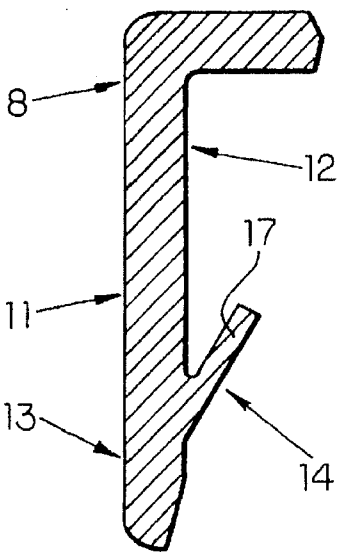
FIG. 5*a* shows a section through the closure with another embodiment form of the retaining device.
Figure 6:
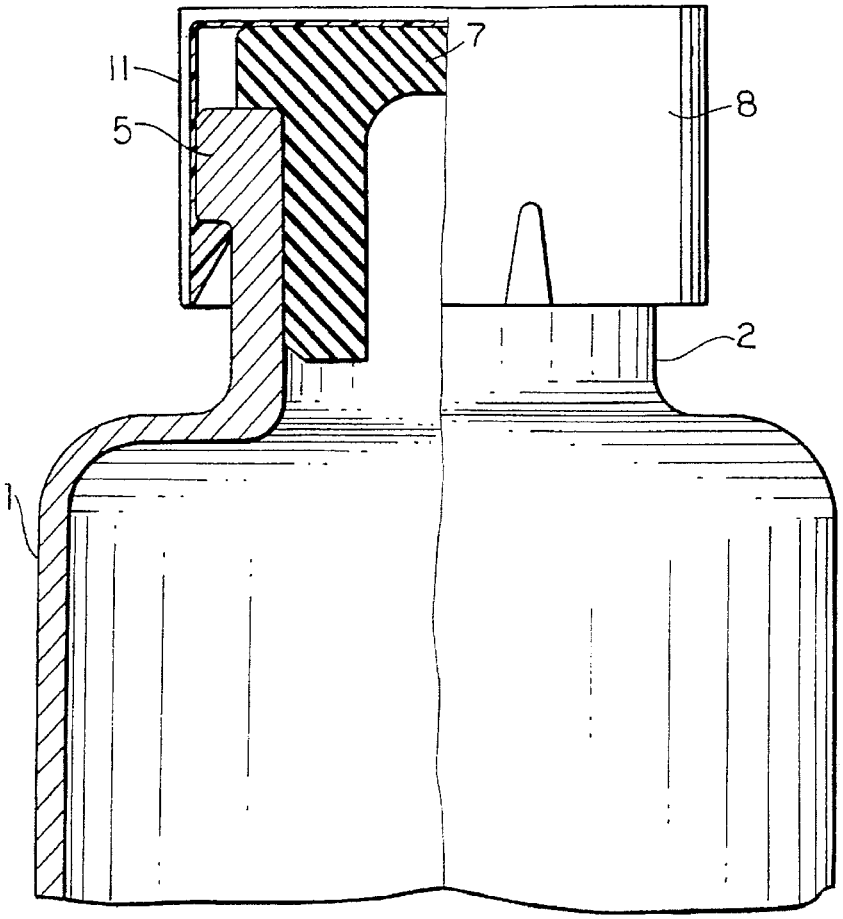
FIG. 6 shows a partial section according to FIG. 1, but with a torn off closure.
Figure 7:
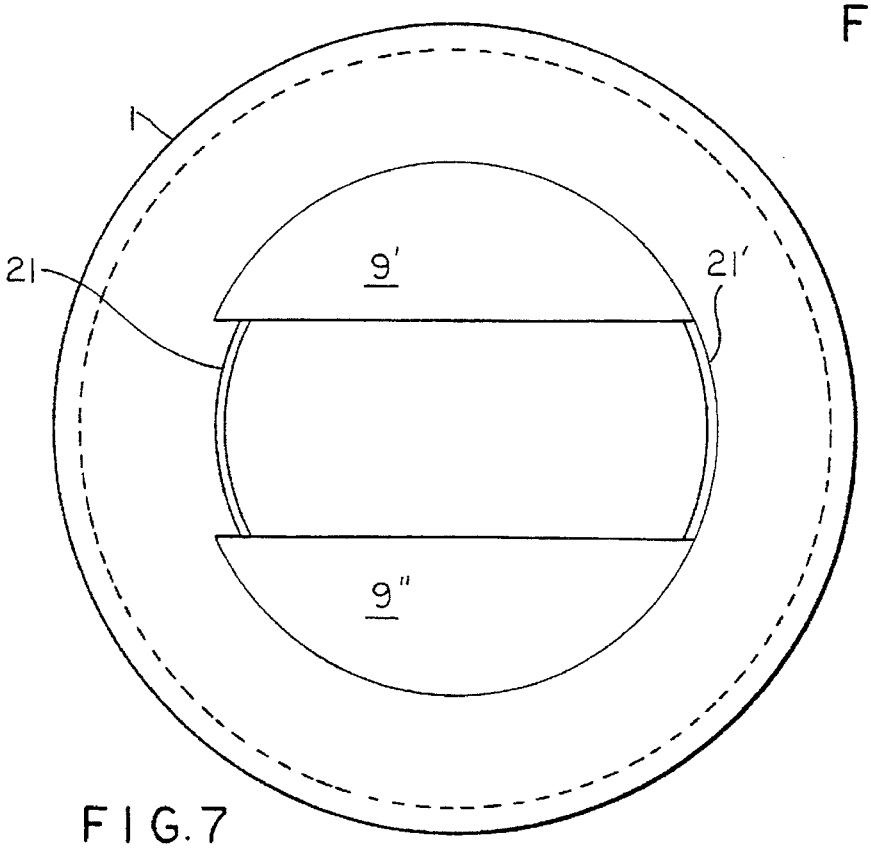
FIG. 7 shows a top view of the torn out closure.

This lip 17 which is shown in FIGS. 5*a*, 5*b* and 5*c* can be adapted substantially better than can the projection 15 described above to the lower edge 6 of the ridge 5' or 5" as a result of the different magnitudes resulting from the differences in dimension mentioned above, since the lip 17 is more easily deformable because of its special construction and, in spite of this or precisely because of the deformation, possesses the clamping force required for holding the closure on the neck of the bottle.

FIGS. 5*b* and 5*c* show the minimum and maximum dimensional differences of the sealing elements 7' and 7" and the ridges 5' and 5" and the different position of the lip 17 brought about by these differences.

The constructions of the lower edge 13 of the closure 8 which are described above ensure that no additional deforming tool will be required to provide a secure fastening of the closure 8 on the container neck 2 after the bottle-shaped container 1 has been filled and accordingly ensure that no contamination can occur in the sterile area, particularly because the closure 8 is produced entirely of plastic.

Figure 2:
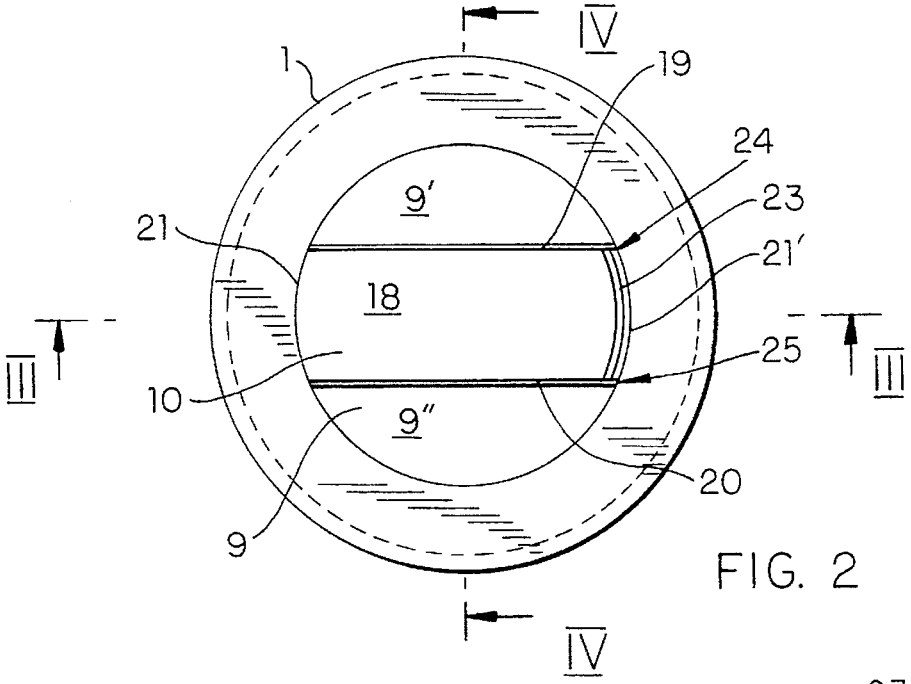
FIG. 2 shows a top view of the unopened closure.

As is shown in FIG. 2, the cap surface 9 of the closure 8 has a tear-out part 10 which is constructed as a strip 18 of determined width extending across the diameter and is connected with the remaining adjoining circular segment-shaped regions 9' and 9" of the cap surface 9 by line-shaped weakened regions 19 and 20 of thinner plastic material.

In order that the edge of the tear-out part 10 can be grasped with the tip of a finger and lifted as indicated in FIG. 1 by arrow A so as to detach it from the cap surface 9 of the closure 8 and accordingly expose the sealing element 7, the jacket 11 is constructed so as to be thinner in this region 21 of its outer circumference, i.e., has a smaller outer diameter corresponding to the width of the strip-shaped tear-out part 10, so that the grip edge 22 of the tear-out part 10 projects over the jacket 11.

Based on the above described construction of closure 8 with tear-out part 10, the user can, in simple fashion, insert his or her fingernails under the grip edge 22 of such a closure on a closed container 1, and lift up the tear-out part 10. In this way, it is released from the cap surface 9 along the line-formed, weakened regions 19 and 20. In this manner, it can be separated completely from the closure and, consequently, the sealing element 7 is opened, e.g., for the penetration of a hypodermic needle. Should it not be desired to have the tear-off portion 10 completely separated from the closure, it can be provided with a hinge 23 which is described in more detail below.

Figure 8:
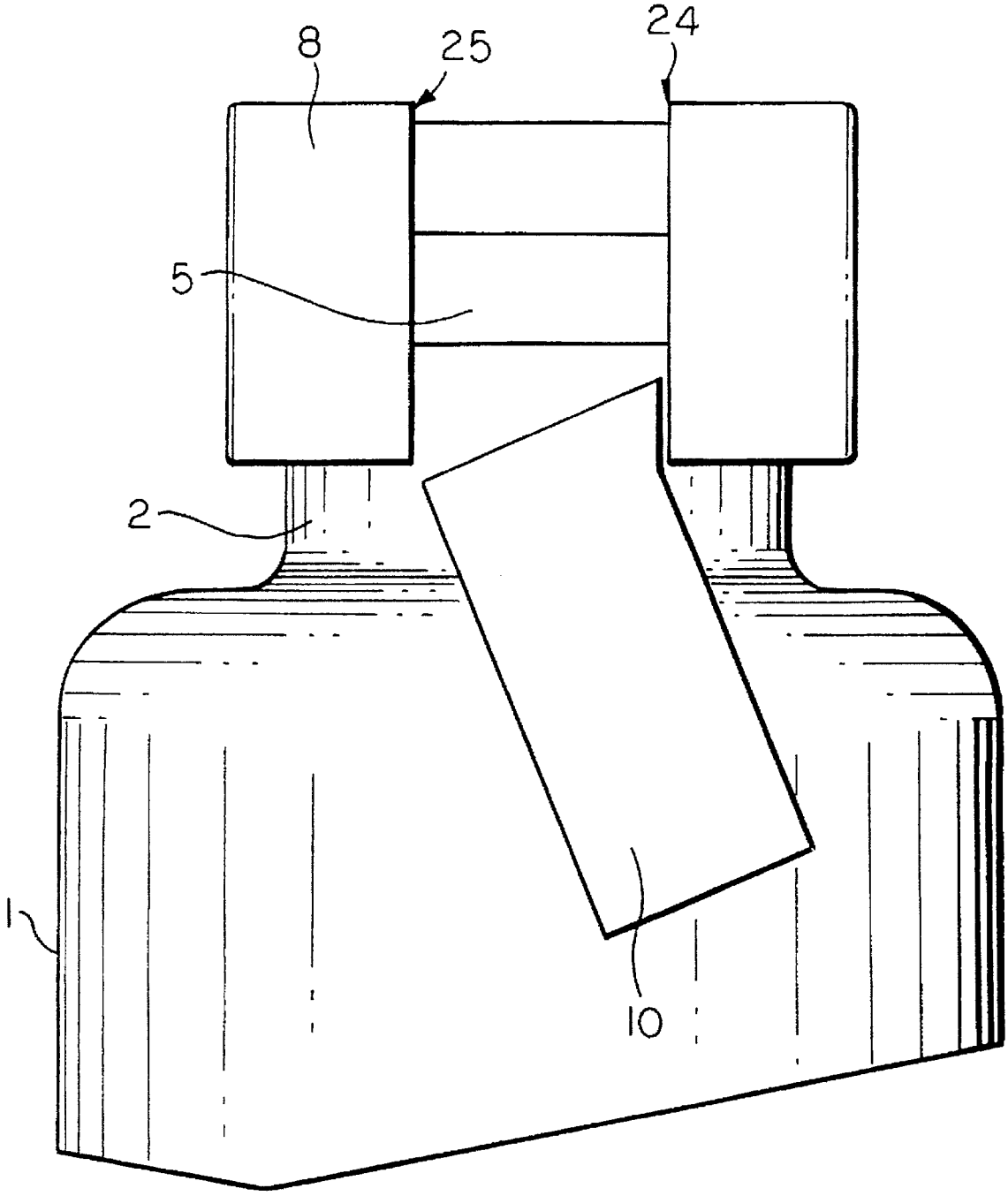
FIG. 8 shows a partial plan view of the container with torn out closure in which the tear-out part is still hanging onto the jacket by one of the weakened regions.

In a particular alterative embodiment, the tear-out part 10 has a hinge-like construction 23 at its edge located opposite the grip edge 21 at which the tear-out part 10 can be folded up when detached from the cap surface 9 and can remain on the closure. Line-shaped weakened regions 24 and 25 can be provided in the jacket 11 within the width of this hinge 23 so that by further pulling on the tear-out part 10, also a part of the jacket 11 of the closure 8 along the path of the pre-formed weakened region 24 and 25, can be detached further so as to be completely removed from the closure 8 or can remain hanging at the jacket 11, as shown in FIG. 8, if one of the line-shaped weakened regions 24 is not guided completely to the edge of the jacket 11, i.e., when not completely detached.

The required line-shaped weakened regions 24 and 25 for the tearing out of the jacket 11 from the closure can, of course, also be provided, if no hinge 23 for the tear-out part 10 is provided, but if the tear-out part, after detachment from the cap surface 9, was completely separated from the closure. Then the user can again grip the edge of the jacket 11 of the closure 8 with the fingernail in the region between the line-shaped, weakened regions 24 and 25 and tear out this portion of the jacket 11 and, by so doing, separate the closure completely from the container 1.

To facilitate the placement of the closure 8 over the sealing element 7 and over the ridge 5 on the rim 4 of the container opening 3, the closure 8 has, for example, two notch-shaped regions 26 in the lower edge 13 of its jacket 11 which are arranged, for example, between the two line-shaped weakened regions 24 and 25 and the thinner jacket region 21 for the grip edge 22 to supplement these regions. The jacket 11 is likewise constructed so as to be thinner in these notch-shaped regions 26, that is, for example, equally as thin as in the line-shaped weakened regions 24 and 25 and/or in the thinner jacket region 21 for the grip edge 22.

Figure 9:
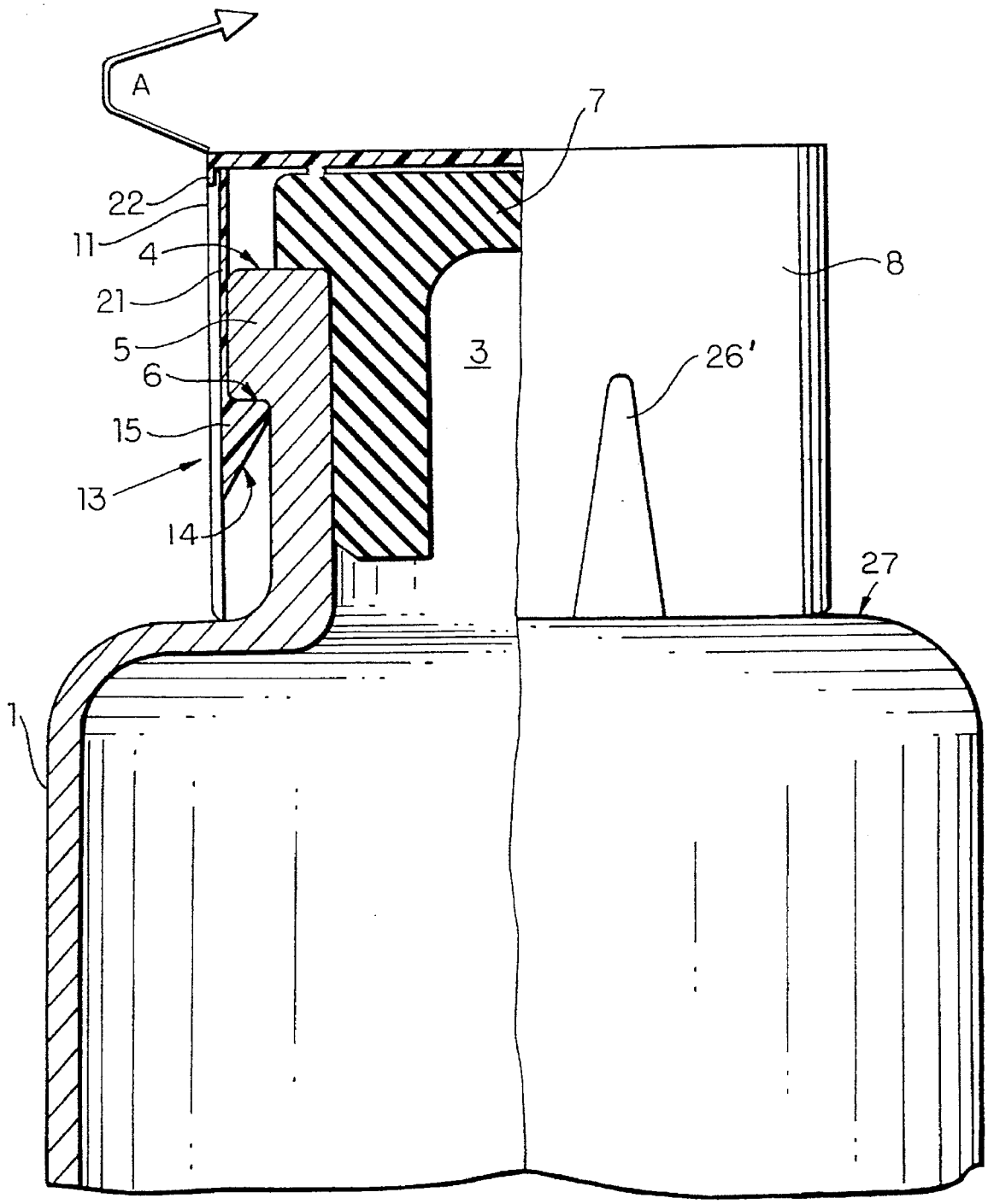
FIG. 9 shows a partial section according to FIG. 1, but with a modified embodiment form of the closure.
Figure 10:
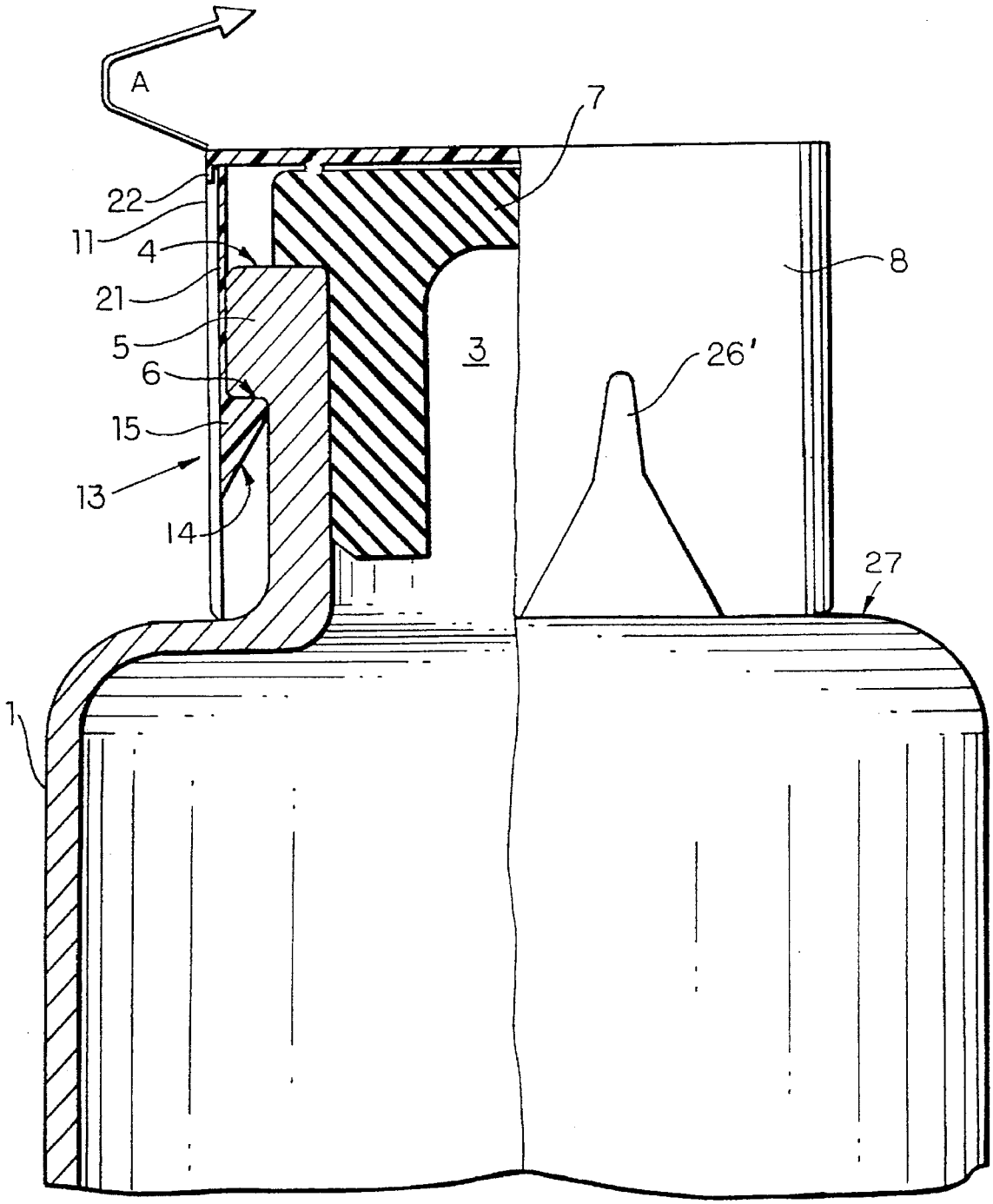
FIG. 10 shows a partial section according to FIG. 9 with another modified embodiment form of the closure.

In order to additionally ensure the authenticity protection of the contents of the container as was discussed above, the edge 13 of the jacket 11 is lengthened downward along its entire circumference as will be seen from FIGS. 9 and 10, so that it practically stands on the shoulder 27 of the container 1.

For this purpose, the edge 13 can taper out continuously in a downward direction in those portions of the extended region of the jacket 11 in which the thickness of the jacket is not reduced. This special construction of the lower region of the edge 13 of the jacket 11 of the closure 8 ensures, furthermore, that this lower edge region will be more easily damaged in the event of tampering with the intent of removing the closure 8 and will show non-removable signs so that it can be determined immediately whether or not that the closure has been tampered with.

An annular ridge 29 which presses the sealing element 7 against the container neck 2 when the bottle-shaped container 1 has been completely closed by the closure 8 is formed out at the underside 28 of the cap surface 9 so as to compensate for any additional manufacturing tolerances in the dimensions of the sealing element 7, 7', 7", container neck 2, ridge 5, 5', 5" and closure 8 and in particular to ensure that the closure 8 comes to rest with its cap surface 9 on the sealing element 7 in a securely closed manner.

While the foregoing description and drawings represent the preferred embodiments of the present invention, it will be obvious to those skilled in the art that various changes and modifications may be made therein without departing from the true spirit and scope of the present invention.

What is claimed is:

1. A tear-off safety closure for ensuring authenticity and for additional sealing of a bottle-shaped container for containing pharmaceuticals which is pre-closed by a sealing element, wherein said container includes a container neck having an outer wall and a rim with an outwardly projecting ridge comprising:

a one-piece closure element produced from thermoplastically deformable plastic in its entirety;

said closure element having a cap surface and a closed flange-shaped jacket for enclosing the sealing element and the rim of the container neck;

said jacket having a plurality of retaining devices arranged on its inner surface at a distance from a lower edge of said jacket;

said retaining devices for engaging under a lower edge of the ridge of the container neck;

said retaining devices being constructed as inner projections which face the outer wall of the container neck and which engage under the lower edge of the ridge;

said closure element having a tear-out part which can be detached from its cap surface;

said tear-out part is constructed as a diametrically extending strip of determined width and is connected with remaining adjoining circular segment-shaped regions of the cap surface by weakened regions formed of thinner plastic material; and one end of said diametrically extending strip is a grip edge which is formed by a region in said jacket which has a reduced outer diameter.

2. The tear-off safety closure of claim 1, wherein said closure element is constructed of polypropylene or polyamide.

3. The closure according to claim 1, wherein the projections are constructed in the form of a shelf having a triangular cross section and a contact surface which engages approximately horizontally under the lower edge of the ridge.

4. The closure according to claim 1, wherein the projections are constructed as elastically deformable lips which are directed at an acute angle into the interior of the closure.

5. The closure according to claim 1, wherein the strip is also connected with at least one of the adjacent edges of the jacket areas by way of weakened regions of thinner plastic material.

6. The closure according to claim 1, wherein two notch-shaped regions are provided in each instance in a lower edge of the jacket between at least one line-shaped weakened regions and a thinner jacket region for the grip edge so as to supplement these regions, the jacket likewise having a thinner construction in these notch-shaped regions.

7. The closure according to claim 6, wherein the edge of the jacket is extended downward along its entire circumference.

8. The closure according to claim 7, wherein the edge can terminate in a downward direction in a continuously tapering manner in those portions of the extended region in which the thickness of the jacket is not reduced.

* * * * *